United States Patent [19]

Rathje et al.

[11] 4,108,251

[45] Aug. 22, 1978

[54] VEHICLE WITH ADJUSTING DEVICE FOR EARTH-MOVING SHIELD THEREOF

[75] Inventors: Uwe Rathje, Dortmund-Niederhofen; Hans Jürgen Schumacher, Dortmund-Asseln, both of Fed. Rep. of Germany

[73] Assignee: O & K Orenstein & Koppel Aktiengesellschaft, Berlin, Fed. Rep. of Germany

[21] Appl. No.: 693,692

[22] Filed: Jun. 7, 1976

Related U.S. Application Data

[63] Continuation of Ser. No. 524,921, Nov. 18, 1974, abandoned.

[30] Foreign Application Priority Data

Nov. 17, 1973 [DE] Fed. Rep. of Germany ..... 2357495

[51] Int. Cl.[2] ..... E02F 3/76

[52] U.S. Cl. ..... 172/789; 172/793

[58] Field of Search ..... 172/780, 781, 784, 785, 172/786, 787, 788, 789, 790, 791, 792, 793, 795, 796, 797

[56] References Cited

U.S. PATENT DOCUMENTS

| | | | |
|---|---|---|---|
| 2,655,743 | 10/1953 | Ross | 172/793 |
| 2,737,736 | 3/1956 | MacDonald | 172/797 |
| 3,038,268 | 6/1962 | Vivier | 172/793 |
| 3,454,110 | 7/1969 | Hanser | 172/793 |
| 3,692,149 | 9/1972 | Evans | 172/793 X |
| 3,739,861 | 6/1973 | Johnson et al. | 172/793 |

FOREIGN PATENT DOCUMENTS

| | | | |
|---|---|---|---|
| 1,484,689 | 4/1969 | Fed. Rep. of Germany | 172/789 |
| 1,269,062 | 5/1968 | Fed. Rep. of Germany | 172/791 |
| 93,753 | 4/1959 | Norway | 172/793 |

*Primary Examiner*—Richard T. Stouffer
*Attorney, Agent, or Firm*—Walter Becker

[57] ABSTRACT

An adjusting device for the main shield of a grader in which two lifting cylinder, a sideways adjusting cylinder and two pivot arms interconnected by an arresting bridge for actuating the main shield are by the arresting bridge linked to a bridge frame of the grader which bridge frame has a rectangular cross section. Each of the two pivot arms are arranged for pivoting about two joints while one of the pivot arms has its free end provided with fulcrums arranged asymmetrically with regard to the vertical axis of symmetry for establishing linkage connection with one lifting cylinder and a sideways adjusting cylinder. The other one of the two pivot arms is at its free ends provided with a fulcrum for establishing linkage connection with the other lifting cylinder. The arrangement is such that one joint each serves for journalling the pivot arms on a front wall fixedly connected to a frame member of the grader and to the back wall likewise fixedly connected to the frame member, whereas another joint edge serves for journalling the pivot arms on the movable arresting bridge. The quadrangular joint structure comprising the above mentioned four joints is non-symmetrically arranged with regard to the axis of symmetry of the vehicle frame member and is displaceably arranged in the vertical plane.

1 Claim, 4 Drawing Figures

VEHICLE WITH ADJUSTING DEVICE FOR EARTH-MOVING SHIELD THEREOF

This is a continuation of application, Ser. No. 524,921 Rathje, et al., filed Nov. 18, 1974, now abandoned.

The present invention relates to an adjusting device for the main shield or share of a grader, in which two lifting cylinders, a sideways adjusting cylinder and pivot arms interconnected by a connecting member for actuating the main shield by means of said connecting member are linked to a bridge frame of a rectangular cross section of a grader.

With a heretofore known levelling knife, pivot arms are linked to a disc-shaped structural element which extends around the frame which latter extends around the front ends of the vehicle and extends toward the front end of the vehicle and is fixedly connected to said frame. The pivot arms are connected to each other through a guide rod. The guide rod carries an adjusting device which comprises said bolt and which during the adjusting movements effected by hydraulic cylinders is displaced together with the guide rod. The unilateral mounting of that cylinder which brings about the sideways adjustment, however, brings about kinematic conditions which are different on both working sides. These kinematic conditions are not taken into consideration in view of the completely symmetrical arrangement of the arresting openings in the disc-shaped structural element and in view of the fact that the pivotal point or fulcrum of the sideways adjusting cylinders and the fulcrum of the lifting cylinder is arranged at the same distance from the center. As a result thereof, it is not possible with the implement to work equally well on both sides. Moreover, there exists the danger that the levelling shield and those cylinders intended for actuating the same will when pivoting from one side to the other side hit the ground or parts of the device whereby parts may be damaged.

It is, therefore, an object of the present invention to provide an adjusting device of the above mentioned general type which will obviate the drawbacks of the heretofore known devices.

It is another object of this invention to provide an adjusting device as set forth in the preceding paragraph in which the actuation of the main shield or share will be so effected that on both working sides the extreme positions necessary for the various operations can be realized with the same kinematic stability without the main shield or share hitting the ground when pivoting and without the cylinders hitting the frame so that any hydraulic turn-off devices or acoustic warning devices will not be needed. Moreover, in the central position and when preparing side slopes, a more favorable lifting height can be obtained so that also slopes or inclined surfaces can be cut below grade.

These and other objects and advantages of the invention will appear more clearly from the following specification in connection with the accompanying drawings, in which.

Figure 1:
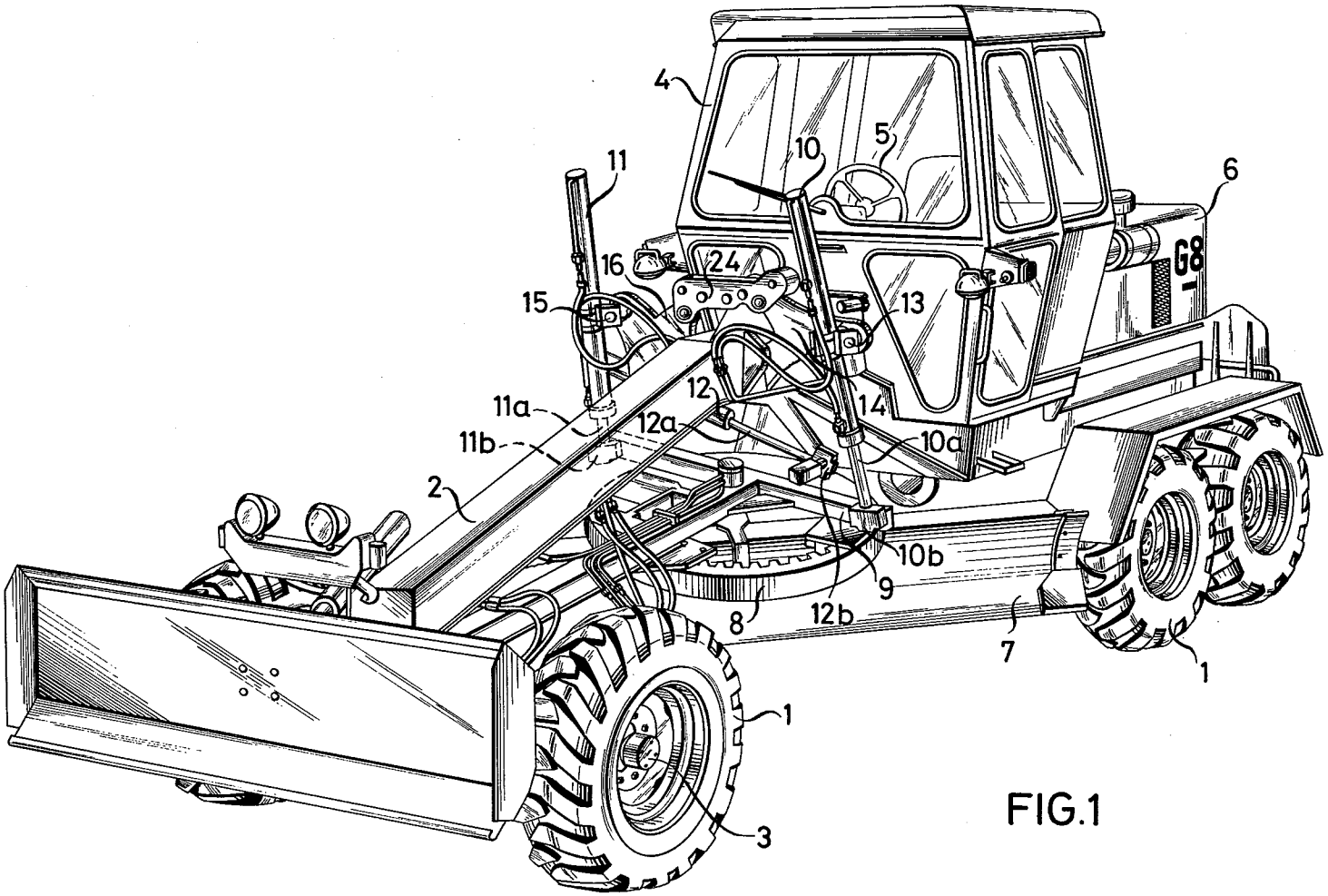
FIG. 1 is an isometric view of the grader according to the invention.

The above outlined objects have been realized according to the present invention by the fact that the two pivot arms are pivotally arranged for pivoting about two fulcrums each while one of said pivot arms is at its free end provided with fulcrums arranged asymmetrically with regard to the vertical plane of symmetry and serving for pivotal connection of one lifting cylinder and of the sideways adjusting cylinder, whereas the other pivot arm is at its free ends provided with a fulcrum serving the pivotal connection of the other lifting cylinder. One fulcrum each serves for mounting the pivot arms on the front wall fixedly arranged on the frame, whereas the likewise fixedly arranged rear wall and one fulcrum each serves for journaling the pivot arms on the movable connecting member. The link quadrangle formed by the joints and comprising the four fulcrums of the pivot arms is arranged non-symmetrically to the axis of symmetry of the vehicle frame and is displaceable in the vertical plane, and the arresting bushings are with their arresting openings in the connecting member arranged nonsymmetrically in such a way that said connecting member is fixed in the most favorable position for the intended working operation.

According to a further development of the invention, the arresting device for arresting the connecting member to the frame and comprising a sleeve, a pressure spring and an arresting bolt, is fixedly arranged on the rear wall which is firmly connected to the vehicle frame and is fixedly arranged in the vertical plane of symmetry.

Referring now to the drawings in detail, the grader equipped with rubber tires 1 and also designated as levelling knife comprises a frame, the front portion of which forms a one-piece bridge frame 2. Connected to the free/end of said frame 2 is an axle 3 with the guidable wheels 1. In the driver's cab 4 there is provided a steering wheel 5 and there are furthermore provided the actuating elements for the vehicle. At the rear end of the vehicle there is below the hood 6 provided the motor for the driving of the vehicle and for driving the hydraulically operable elements. The main shield or share 7 which serves primarily for moving earth, is connected to a gear ring or ring mount 8 which is rotatable about a vertical axis and which is linked to the front end of the bridge frame 2 by means of the shield carrier 9. In addition thereto, the gear ring or ring mount 8 which is connected to the shield carrier 9 is held by two lifting cylinders 10 and 11 and by a sideways adjusting cylinder 12. The lifting cylinder 10 engages with its free end of its piston rod **10*a* the pivot point 10*b* which is firmly arranged on the shield carrier 9. The lifting cylinder 10 is pivotally journalled in the fork 13 which at the pivot point 13*a* is connected to the pivot arm 14. The lifting cylinder 11 has the free end of its piston rod 11*a* engage the pivot point 11*b* which is fixedly arranged on the shield carrier 9. The lifting cylinder 11 is pivotally journalled in the fork 15 which at the pivot point 15*a* is connected to the pivot arm 16. The sideways adjusting cylinder 12 is by means of the free end of its piston rod 12*a* in engagement with the pivot point 12*b* which is arranged on the shield carrier 9 while being offset with regard to the pivot point 11*b*. The sideways adjusting cylinder 12 is pivotable in the fork 18 which is rotatably journalled in the pivot point 19 on the pivot arm 14. Pivoted on the bridge frame 2 in its horizontal portion thereof there are welded thereto the front wall 20 and the rear wall 21. The pivot arms 14 and 16 are pivotally mounted in the front and rear wall 20, 21 at the pivot points 22, 23. These pivot points 22, 23, according to the invention, are relative to the horizontal plane offset by approximately one-fifth of the width of the bridge frame. The pivot arms 14 and 16 are interconnected by means of the arresting bridge 24 by the pivot points 25, 26. In the bridge 24 there are arranged arresting bridges 27–31 which are correspondingly provided with arresting openings 27***a*, 28*a*, 29*a*, 30*a* and 31*a*. In the longitudinal axis of the vehicle frame there is provided the arresting bushing 31 with the arresting opening 31*a*, relative to which the remaining arresting openings through the intervention of the horizontals passing through the arresting opening 31*a* are arranged at different distance and at a distance increasing in a direction toward the outside. An arresting device 32 is screwed to the rear wall 31, which arresting device 32 comprises a sleeve 32*a*, a pressure spring 32*b*, and the arresting bolt 32*c*. The arresting bolt 32*c* is actuated from the driver's cab 4 by means of a cable 32*d*.

Figure 2:
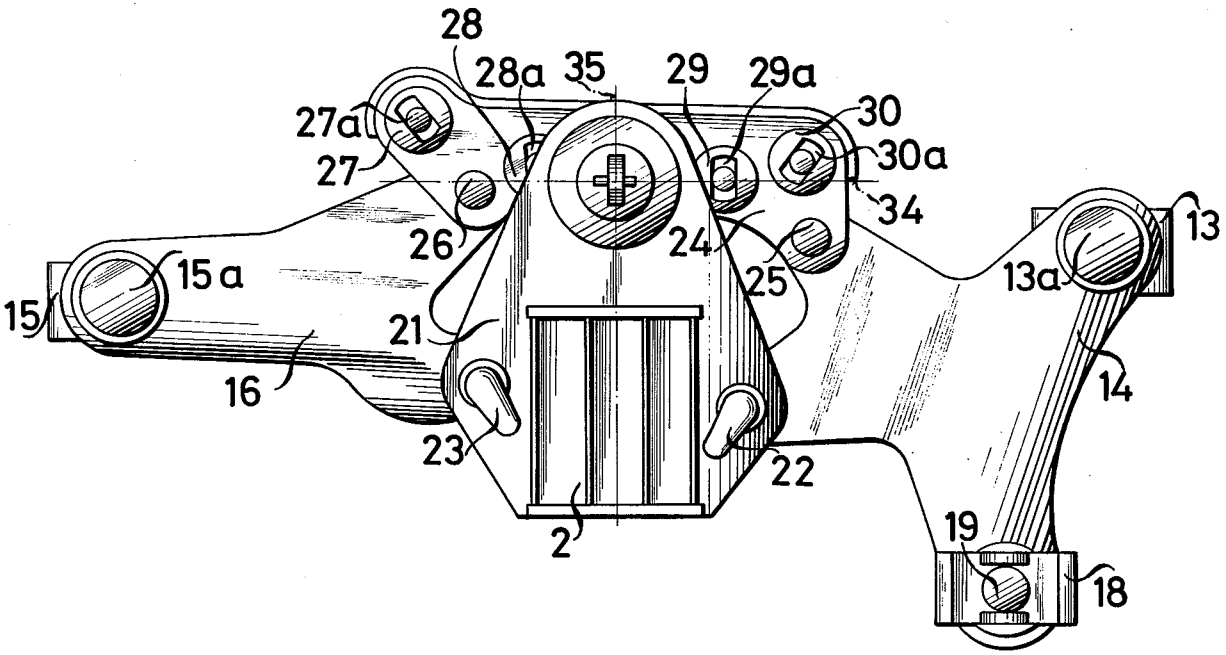
FIG. 2 shows the adjusting device according to the invention in driving direction.
Figure 3:
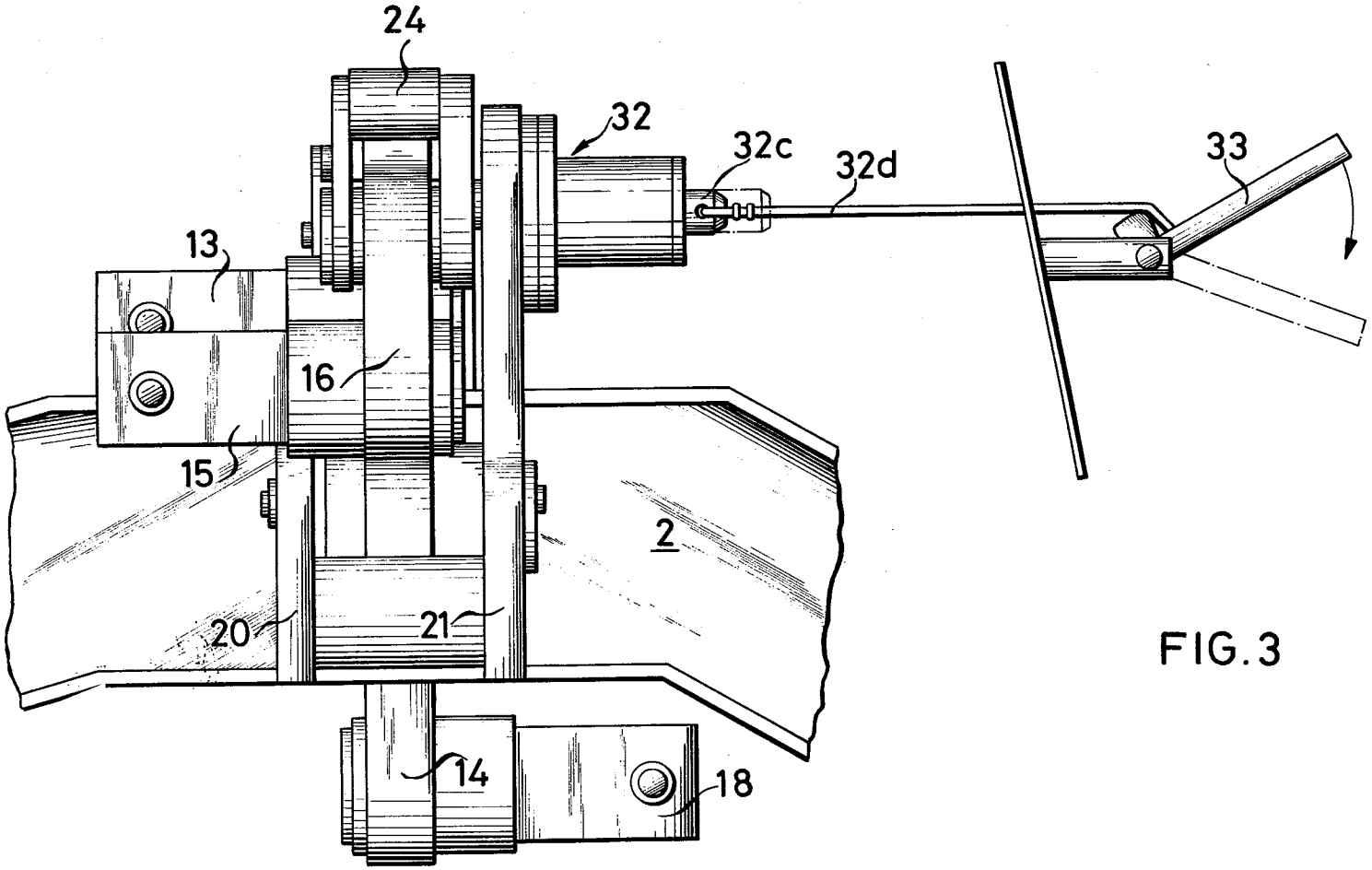
FIG. 3 is a side view of the adjusting device according to the invention.
Figure 4:
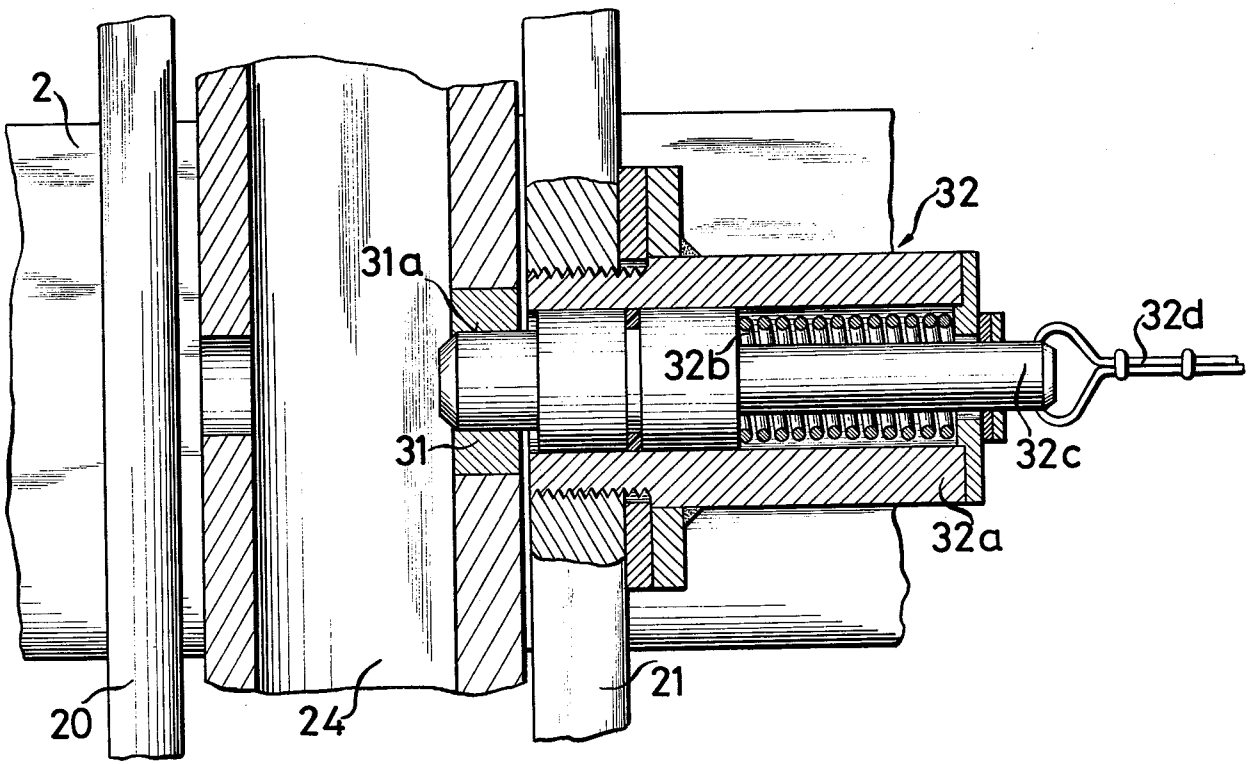
FIG. 4 is a section through the arresting device.

The operation is as follows: for purposes of pivoting the main shield or share 7 toward the left or toward the right as is necessary for instance for preparing slopes and inclined surfaces, the operator will by means of the lever 33 first actuate the cable 32*d* so that the arresting bolt 32*c* is pulled out of the arresting opening 31*a*. Thereupon the operator will be able by actuating the lifting cylinders 10 and 11 and the sideways adjuting cylinder 12 to pivot the main shield 7 toward the left or toward the right and to lower the same in conformity with the requirements. As soon as the arresting opening most favorable for the respective working operation has been reached, the operator releases the cable 32*d* for the arresting bolt 32*c* and the latter engages the corresponding arresting opening for instance 30*a*. As will be evident from FIG. 2, the offset of the fulcrum 25 and 26 relative to each other corresponds to that of the pivot points 22 and 23 whereby an optimum design of the quadrangular joint comprising said points is formed. The corresponding association of the spacing between the arresting bore 27*a*–31*a* of the arresting member 24 relative to the horizontal axis of symmetry 34, in cooperation with the above mentioned asymmetric arrangement of the points of the joint quadrangle brings about the advantageous design of the adjusting device according to the invention.

The advantage of the arrangement according to the present invention consists primarily in that the working range is on both working sides considerably improved without the employed parts having to be dimensioned stronger. The movements of the actuating elements and of the main shield are effected kinematically in a plurality of planes in such a way that the actuating elements and the main shield will not hit the frame nor hit each other.

It is, of course, to be understood, that the present invention is, by no means, limited to the specific showing in the drawings but also comprises any modifications within the scope of the appended claim.

What we claim is:

1. In a vehicle, a frame extending forwardly to the front end of the vehicle and supported on wheels at said front end, an earth-moving shield behind said wheels and a shield carrier supporting said shield, supporting and adjusting means for said shield carrier including a support member fixed relatively to said frame, a pair of arms pivotally connected to opposite sides of said support member and extending laterally outwardly therefrom, a pair of piston-cylinder lifting devices each having one of two telescoping elements pivoted to the outer end of one of said arms, the other telescoping elements of said devices being pivotally connected to opposite ends of said shield carrier, a third sideways adjusting piston-cylinder device having one of its two elements connected to the end of the first of one of said arms spaced below the connection to the one of the two piston-cylinder elements to said arm and the other of its elements extending across to the opposite side of said shield carrier with its end pivotally connected to said carrier at a point offset from the pivoted connection of the piston-cylinder element to the second of said one of said arms on that side, an opening through said support member, a bridge member extending transversely across said support member and pivotally connecting said two arms and having a central opening and at least two laterally spaced openings on each side of said central opening and movable to different positions to register selectively one of its openings with the opening in said support member, so that said openings on each side of the central opening will provide for different positions of said shield, said arms being asymmetrically arranged with the pivot connections of the second of said arms to said support member and said bridge member displaced vertically higher than the corresponding pivot connection of the first of said arms, the openings on opposite sides of the central opening in said bridge member being asymmetrical about a vertical plane through said central opening, with the two openings in the side adjacent the first arm being spaced from the central opening a less distance than the pivot connection of said bridge member to said first arm, and the laterally more outward opening in the bridge member on the side adjacent said second arm being spaced farther from said central opening than the pivot connection of said bridge member to said second arm and above said central opening when the bridge member is in its central position, and a locking bolt mounted on said support member and insertable into said registered openings of said bridge member and said support member to lock said bridge in a fixed position on said support member.

* * * * *